US005655176A

United States Patent [19]

Inoue et al.

[11] Patent Number: 5,655,176

[45] Date of Patent: Aug. 5, 1997

[54] IMAGE FORMING APPARATUS HAVING DISCHARGER WHICH IS CONTROLLED ACCORDING TO SHEET RIGIDITY

[75] Inventors: Masahiro Inoue, Yokohama; Tatsuo Takeuchi, Kawasaki, both of Japan

[73] Assignee: Canon Kabushiki Kaisha, Tokyo, Japan

[21] Appl. No.: 358,143

[22] Filed: Dec. 16, 1994

[30] Foreign Application Priority Data

Dec. 17, 1993 [JP] Japan ..... 5-344210

[51] Int. Cl.[6] ..... G03G 15/00

[52] U.S. Cl. ..... 399/45; 399/315

[58] Field of Search ..... 355/208, 271, 355/272, 274, 315; 399/45, 315

[56] References Cited

U.S. PATENT DOCUMENTS

| | | | |
|---|---|---|---|
| 4,190,348 | 2/1980 | Friday | 355/274 |
| 4,468,113 | 8/1984 | Motohashi | 355/271 X |
| 5,383,010 | 1/1995 | Sakurai | 355/271 |

FOREIGN PATENT DOCUMENTS

| | | |
|---|---|---|
| 57-004062 | 1/1982 | Japan . |
| 0004062 | 1/1982 | Japan . |
| 0064270 | 4/1982 | Japan . |
| 57-064270 | 4/1982 | Japan . |
| 58-005756 | 1/1983 | Japan . |
| 0005756 | 1/1983 | Japan . |
| 0190885 | 7/1990 | Japan . |
| 2190885 | 7/1990 | Japan . |

*Primary Examiner*—Robert Beatty

*Attorney, Agent, or Firm*—Fitzpatrick, Cella, Harper & Scinto

[57] ABSTRACT

An image forming apparatus includes a recording material bearing member that bears recording material; an image forming device for forming an image on the recording material carried on the recording material carrying member, in an image forming station; and a discharger for discharging the recording material after the image is formed on the recording material, the discharger including an outside discharger disposed adjacent an image bearing surface side of the recording material; wherein a discharging operation of the discharger is changed in response to a rigidity of the recording material. Specifically, the discharging power is rendered weaker or stops its operation when the rigidity is larger than a specific value.

25 Claims, 10 Drawing Sheets

IMAGE FORMING APPARATUS HAVING DISCHARGER WHICH IS CONTROLLED ACCORDING TO SHEET RIGIDITY

FIELD OF THE INVENTION AND RELATED ART

The present invention relates to an image forming apparatus, for example, electro-photographic apparatuses or electrostatic recording apparatuses, such as copying machine, laser beam printer, facsimile, and the like.

FIG. 10 is a schematic view of a full-color laser beam printer as a typical image forming apparatus according to a prior art. The apparatus in the drawing uses four primary colors.

In this apparatus, a photosensitive drum 103 is charged with a primary charger 105, and then, is exposed with a laser beam scanner 6, whereby an electrostatic latent image is formed thereon. Next, this electrostatic latent image is developed with a developing device 107M containing magenta toner into a magenta toner image on the drum. The magenta image is transferred with a transfer charger onto a sheet of recording medium P borne on a transfer drum 109.

Thereafter, a cyan toner image, a yellow toner image, and a black toner image are developed with developing devices 107C, 107Y, and 107K, respectively, on the photosensitive drum 103, and then, the toner images are transferred in a superimposing manner onto the recording medium P borne on the transfer drum 109. After four toner images of different color are transferred onto the recording medium P, the recording medium P is separated by a separating claw 125 while the recording medium P is discharged by a separation charger.

when the recording medium P is separated from the transfer drum 109, a recording medium bearing sheet 111 and the recording medium are discharged by an inside discharger 113 and an outside discharger 115.

The recording medium P having been separated from the transfer drum 109 is subjected to the fixing operation of a fixing apparatus 130.

In the case of the above image forming apparatus according to the prior art, a very preferable image can be formed when a recording medium having a Clark degree (JIS P8143) of no more than 156 ($cm^3/100$) (equivalent to a basis weight of approximately 105 $g/m^2$) is used.

However, when the recording medium having a Clark degree in excess of 150 ($cm^3/100$) is used, the recording medium comes in contact with an outside discharger 115 and a separator charger 116 after the recording medium is separated from a transfer drum 105, and as a result, an unfixed image having transferred onto the recording medium is liable to be disturbed.

More specifically, prior to the separation of the recording medium P from the transfer drum 109, the recording medium P is discharged together with a recording medium bearing sheet 111, and then, the recording medium bearing sheet 111 is discharged at the time of separation. In order to carrying out such an operation, dischargers 113 and 115 are disposed inside and outside the transfer drum 109, respectively, on the downstream side of the transfer charger 112 of the transfer drum 109, relative to the direction in which the recording medium is conveyed, and also, a separator charger 116 is disposed on the downstream side of the outside discharger 115.

When the recording medium P is thin, that is, when it has a Clark degree of no more than 156 ($cm^3/100$), it is conveyed in a manner so as to slide in contact with the surface of the separation claw 125 as the separation claw 125 separates it from the transfer drum 109. Therefore, there will be no problem.

On the contrary, when the recording medium P is thick, that is, when the Clark degree of the recording medium P exceeds 156 ($cm^3/100$), the recording medium P straightens itself away from the surface of the separation claw 125 as the separation claw 125 separates it from the transfer drum 109, as illustrated in FIG. 8, due to the resiliency of the recording medium P which is proportional to the Clark degree. Therefore, the recording medium P comes in contact with the outside discharger 115 of the transfer drum 109 and/or the separator discharger 116, disturbing the unfixed toner image thereon. As a result, a low quality image is created.

SUMMARY OF THE INVENTION

The primary object of the present invention is to provide an image forming apparatus in which a sheet of highly resilient recording medium, such as thick paper, can be separated in a preferable manner from a recording medium bearing member.

Another object of the present invention is to provide an image forming apparatus in which when recording medium is separated from a recording medium bearing member, an unfixed image borne on the recording medium is not disturbed.

Another object of the present invention is to provide an image forming apparatus in which when recording medium is separated from a recording medium bearing member, the discharging sequence for discharging means that removes the charge from the recording medium is switched in response to the thickness of the recording medium.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Below, the embodiments of the present invention will be described with reference to the drawings.

Figure 1:
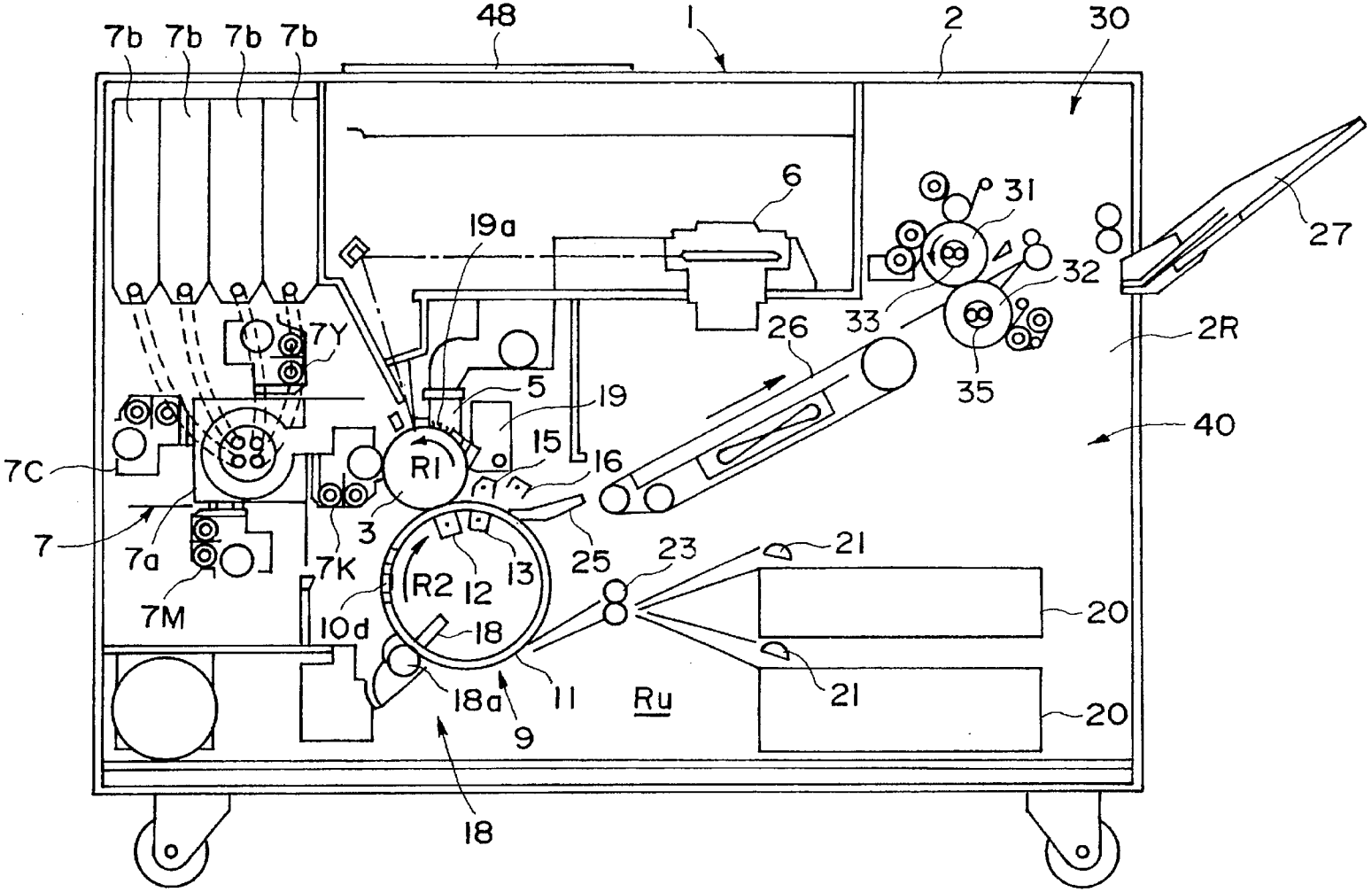
FIG. 1 is a schematic sectional view of an embodiment example of image forming apparatus according to the present invention.

FIG. 1 is a schematic sectional view of an embodiment example of the image forming apparatus according to the present invention, as a color laser beam printer.

Referring to FIG. 1, an image forming apparatus 1 comprises a cylindrical photosensitive drum 3 as an image bearing member. The photosensitive member is disposed substantially at the center of the main frame 2 of the apparatus, being rotatively supported by the main frame 2 so as to be driven in the direction of an arrow R1 by a driving apparatus (unillustrated), and its surface is coated with a photosensitive layer.

The image forming apparatus further comprises a primary charger 5 that uniformly charges the surface of the photosensitive drum 3, an exposing apparatus 6 that forms an electrostatic latent image as it irradiates light onto the surface of the photosensitive drum 3; and a developing apparatus 7 that develops the electrostatic latent image into a toner image. They are disposed in this order around the photosensitive drum 3 in the rotational direction.

The developing apparatus 7 illustrated in FIG. 1 is a rotary developing apparatus. It comprises a rotary member 7*a* supported by the main frame 2 of the image forming apparatus, four developers 7M, 7C, 7Y, and 7K mounted on this rotary member 7*a*. These four developing devices contain negatively charged toners, that is, magenta, cyan, yellow, and black toners (developers), respectively. They are sequentially rotated into a developing station that faces the photosensitive drum 3 as the rotary member 7*a* rotates. At the developing station, the color toner correspondent to the color which the electrostatic latent image is to be developed into, is adhered onto the electrostatic latent image formed on the photosensitive image, forming a primary color toner image. This process is sequentially repeated for each color; therefore, in order to print a full-color image composed of four primary colors, each of the developers 7M, 7C, 7Y, and 7K develops its own latent image on the photosensitive drum 3. The image forming apparatus 1 further comprises four hoppers 7*b*, which are disposed above the developing apparatus 7 and supply the tones to correspondent developing devices 7M–7K.

In addition, the image forming apparatus 1 comprises a transfer drum 9 as a recording medium bearing member, which is disposed on the downstream side of the developing apparatus 7 relative to the rotational direction of the photosensitive drum 3. The transfer drum 9 is cylindrical in overall configuration, and is supported by the main frame 2 of the image forming apparatus 1, rotatively and in contact with the photosensitive drum, so that it can be rotated in the direction of an arrow R2.

In this embodiment example, the diameter of the photosensitive drum 3 and transfer drum 9 are 80 mm and 160 mm (twice the former), respectively.

Figure 11:
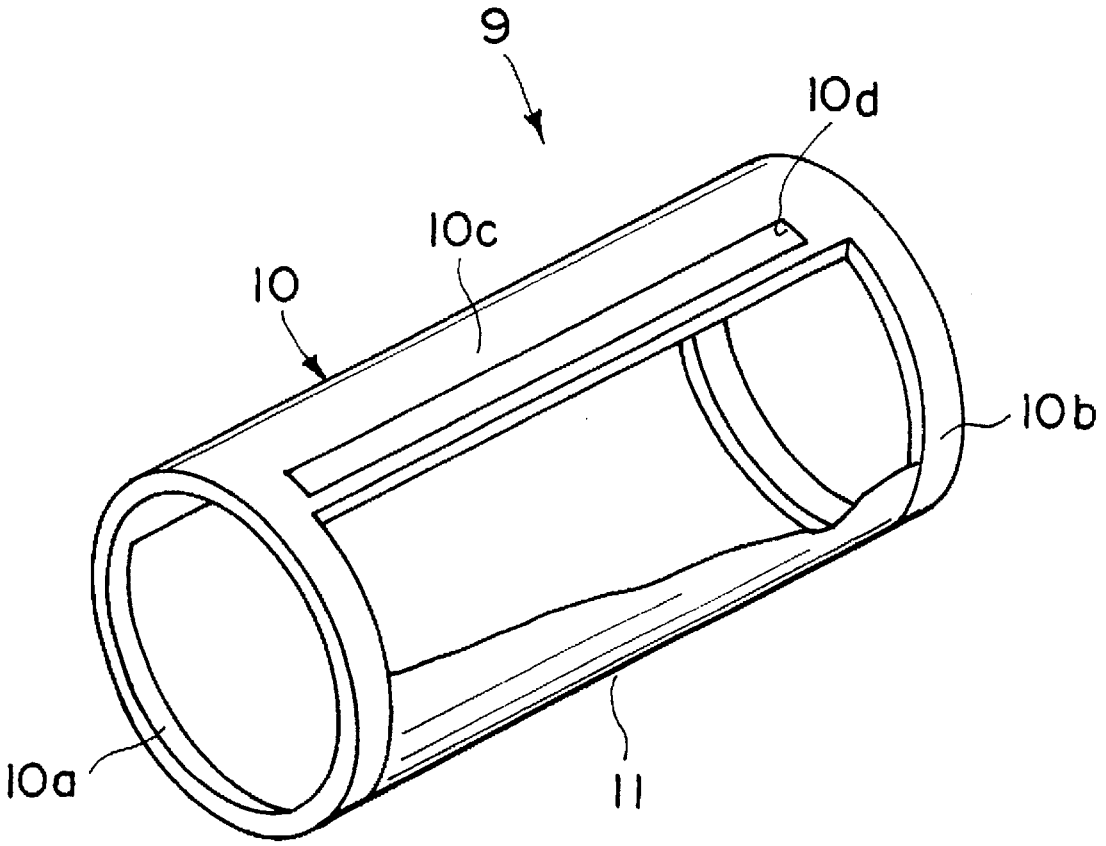
FIG. 11 is a partially cutaway oblique view of a transfer drum of an image forming apparatus.

FIG. 11 is a partially cutaway detail view of the transfer drum 9. The transfer drum 9 comprises a frame member 10 made of metallic material or the like, and a recording medium bearing sheet 11 stretched around the circumference thereof. The frame member 10 comprises a pair of ring-like cylinders 10*a* and 10*b*, and a connecting member 10*c* that connects this pair of cylinders 10*a* and 10*b*. Also, it comprises a recording medium gripper 10*d*. A slight gap is provided between one of the longitudinal edges of the recording medium gripper 10*d* and the connecting member 10*c*, and the leading edge of the recording medium P is held in this gap.

As for the material for the recording medium bearing sheet 11, film of separative dielectric material such as film of polyethylene-telephthalate resin or polyvinylidene fluoride (PVdF) resin is employed. Its thickness is preferred to be 100 μm–175 μm, and its volmetric resistivity is preferred to be $10^{14}\Omega$–$10^{15}\Omega$. The recording medium bearing sheet 11 is stretched in a manner to enclose a cylindrical space formed by the two ring-like left and right cylindrical portions 10*a* and 10*b*, and the connecting member 10*c*. More specifically, the recording medium bearing sheet 11 is attached to the cylinders 10*a* and 10*b*, on their external circumferential surfaces, by the one opposing pair of edges, and also, is attached to both of the longitudinal edges of the connecting member 10*c*, by the other opposing pair of edges, respectively. Therefore, the external circumferential surface of the transfer drum 9 is substantially covered with recording medium bearing sheet 11.

Figure 10:
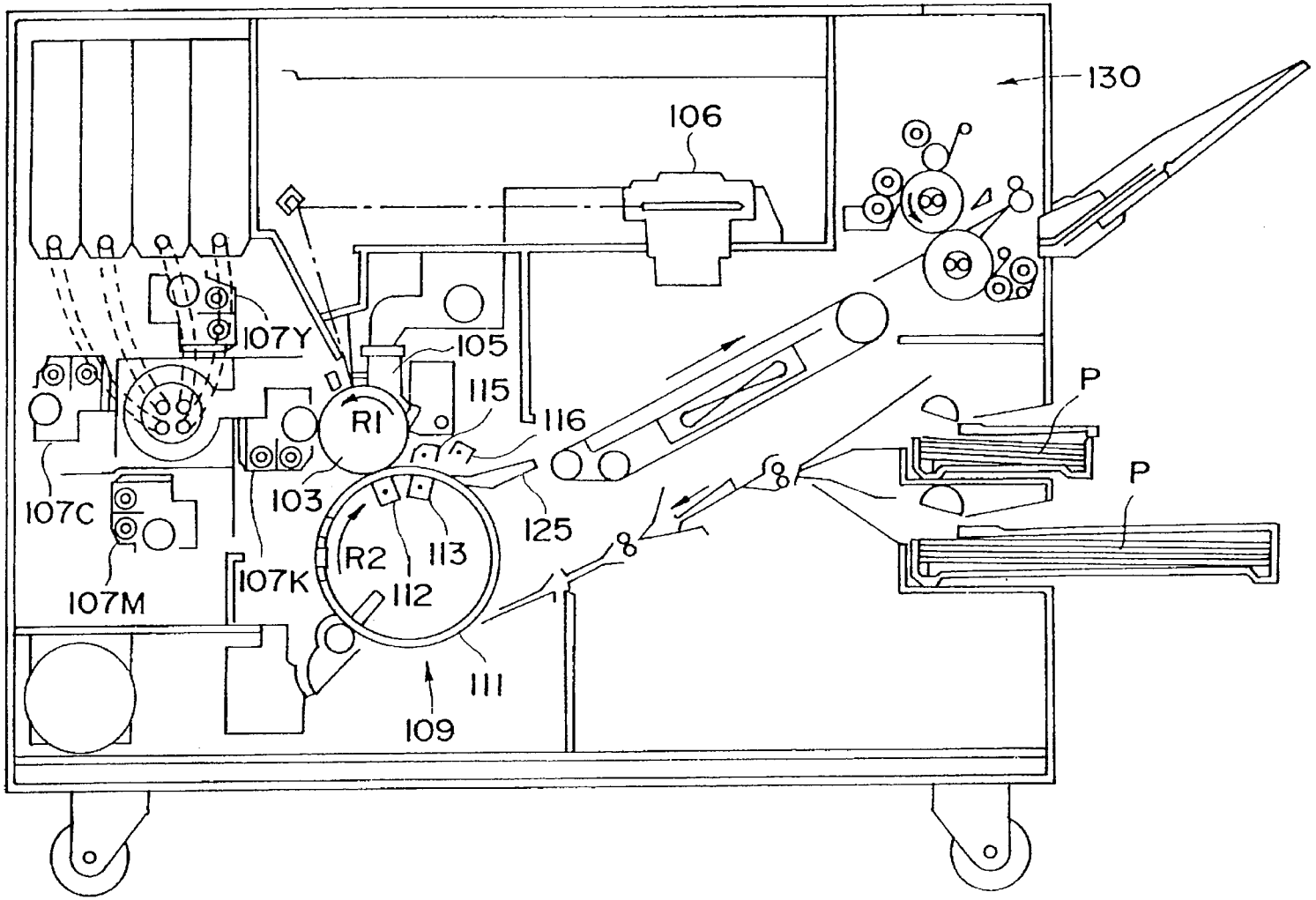
FIG. 10 PRIOR ART
FIG. 10 is a schematic sectional view of an image forming apparatus according to a prior art.

Referring to FIG. 10, a transfer charger 12 as transferring means is disposed within the photosensitive drum 9, at a location opposing the photosensitive drum 3, and an inside discharger 13 as discharging means is closely disposed on the downstream side. Further, an outside discharger 15 as the discharging means is disposed outside the transfer drum 9, at a location opposing the inside discharger 13, and slightly downstream, a separation charger 16 and separation claw 25 as separating means are disposed.

The transfer charger 12 is constituted of, for example, a corona discharger, wherein the voltage and current applied to the wire are +6 kV–+9 kV and +25 μA–500 μA, respectively. The inside and outside dischargers 13 and 15 that discharge the recording medium bearing the transferred toner image are an AC corona discharger (12 kVpp, 800 μA) to which a DC bias (–0.7 kV—3.0 kV, –50 μA–265 μA) can be applied during an AC oscillation. The AC components of the inside and outside dischargers 13 and 15 are controlled to be in reversal phase to each other. The separator charger 16 is an AC charger (10 kVpp, 600 μA).

There is a cleaning apparatus 18 diagonally below the transfer drum 9. It comprises a fur brush 18*a* or the like that removes the residual toner on the surface of the recording medium sheet 11, and an auxiliary cleaning means 18*b* that is disposed within the transfer drum 9 in a manner to oppose the fur brush 18*a*. The fur brush 18*a* is rotatively driven by an unillustrated driving means.

There is a cleaning apparatus 19 on the downstream side of the transfer drum 9, relative to the rotational direction (direction of an arrow R1) of the photosensitive drum 3, close to the primary charger 5. It comprises a cleaning blade 19*a* composed of elastic material, and removes the residual toner on the photosensitive drum 3 as the tip of the blade 19*a* is pressed upon the surface of the photosensitive drum 3.

An overall sheet delivery path Ru of the recording medium P is laid out so that the recording medium P is fed in from the downward right side surface 2R of the main frame 2; conveyed toward the transfer drum 9; receives the toner image while it is borne on the transfer drum 9; and is discharged from the transfer drum 9 upward the right side surface R of the main frame 2.

There are provided two or more sheet feeding cassettes 20 containing recording medium of different sizes, at the starting point of the sheet delivery path Ru. It is exchangeably mounted on the main frame 2, on the right side surface. Further, there is a sheet feeding roller 21 for feeding the recording medium P from the feeder cassette 20 into the sheet delivery path Ru, up above the forward end of the sheet feeder cassette 20, and further downstream, there are a conveyer roller 22 and a registering roller 23, in this order. As the recording medium P is delivered from the registering roller 23 to the transfer drum 9, the recording medium gripper 10*d* grips the leading end of the recording medium P, and then, as the transfer drum 9 rotates, the recording medium P is entirely wrapped around the recording medium bearing sheet 11 of the transfer drum 9.

Further, there is a separator claw 25 diagonally upward on the right hand side of the transfer drum 9. Its tip portion is placed close to the transfer drum 9 surface and separates the recording medium P from the transfer drum 9 after the toner image is transferred. Further downstream, there are a conveyer belt 26 that conveys the recording medium P having been separated by the separator claw 25 toward a fixing apparatus 30, and a sheet catching tray 27 into which the fixed recording medium P is discharged.

The fixing apparatus 30 comprises a fixing roller 31 containing a heater 33, and a pressing roller 32 containing a heater 35. While the recording medium P, onto which the toner image has been transferred, is passed between these two rollers, heat and pressure is applied so that the toner image borne on the recording medium P is fixed to the recording medium P as a permanent image.

A laser printer structured as described above goes through the following process to print a full-color image composed of four primary colors, when plain paper is used as the recording medium.

First, the surface of the photosensitive drum 3 is uniformly charged by the primary charger 5 to a potential ranging from −500 V to −800 V while the photosensitive drum 3 is rotated in the arrow R1 direction at 160 mm/sec. Next, it is exposed by the laser beam exposing apparatus 6, with a laser beam carrying the imaging information for the first color, for example, the magenta color, whereby the first electrostatic latent image is formed on the photosensitive drum 3 surface. Then, the magenta color developing device 7M of the developing apparatus 7 is moved to a location that directly faces the photosensitive drum 3, and develops in reverse the first electrostatic latent image formed on the photosensitive drum 3, into a magenta toner image on the photosensitive drum 3.

Meanwhile, the sheet feeding roller 21 is rotated to feed the recording medium P from the feeder cassette 20 into the sheet delivery path Ru. The fed recording medium P is conveyed to the transfer drum 9 by the conveyer roller 22 and registering roller 23 disposed along the sheet delivery path Ru. The leading end of the recording medium P delivered to the transfer drum 9 is gripped by the recording medium gripper 10*d*, and as the transfer drum 9 is rotated in the arrow R2 direction, the recording medium P is tightly wrapped around the surface of the transfer drum 9, as described before.

The recording medium P borne on the transfer drum 9 is rotated into an image transfer station, where it directly faces the photosensitive drum 3 and is subjected to a corona discharged by the transfer charger 12, from behind the recording medium bearing sheet 11, whereby the toner image on the photosensitive drum 3 is transferred onto the recording medium P. At this time, the polarity of the corona is reverse to that of the toner.

After the completion of four transfer operations, that is, the transfer operations for the magenta, cyan, yellow, and black toner images, the recording medium P is separated from the transfer drum 9 by the function of the separator claw 25 while being discharged by the separation charger 16 that suppresses the separation discharge, and then, is conveyed to the fixing apparatus 30 by the conveyer belt 26. In the fixing apparatus 30, the recording medium P is subjected to the heat and pressure so that the toner images are fixed to the recording medium P, and is discharged out of the main frame 2 onto the external sheet tray 27.

Meanwhile, when the recording medium P is separated from the transfer drum 9, the residual transfer charge on the recording medium bearing sheet 11 is discharged by the dischargers 13 and 15 to prepare the transfer drum 9 for the transfer operation of the next image formation. As for the photosensitive drum 3, it is used for the next image formation after the residual toner on its surface is cleaned by the cleaning apparatus 19.

Figure 2:
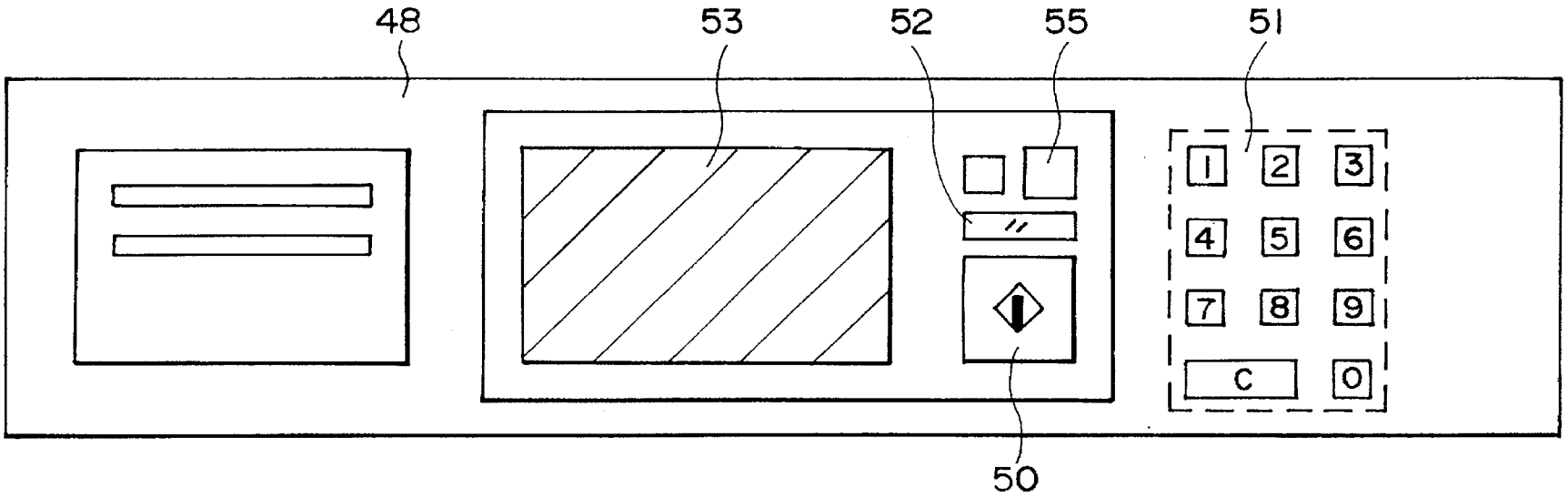
FIG. 2 is a top view of the image forming apparatus illustrated in FIG. 1, and depicts a control panel.

Further, referring to FIG. 2, a control panel 48 of the image forming apparatus of this embodiment comprises a thick paper key 55, in addition to a copy key 50, a copy count selection key 51, a reset key 52, a large touch panel display 53, or the like.

Figure 3:
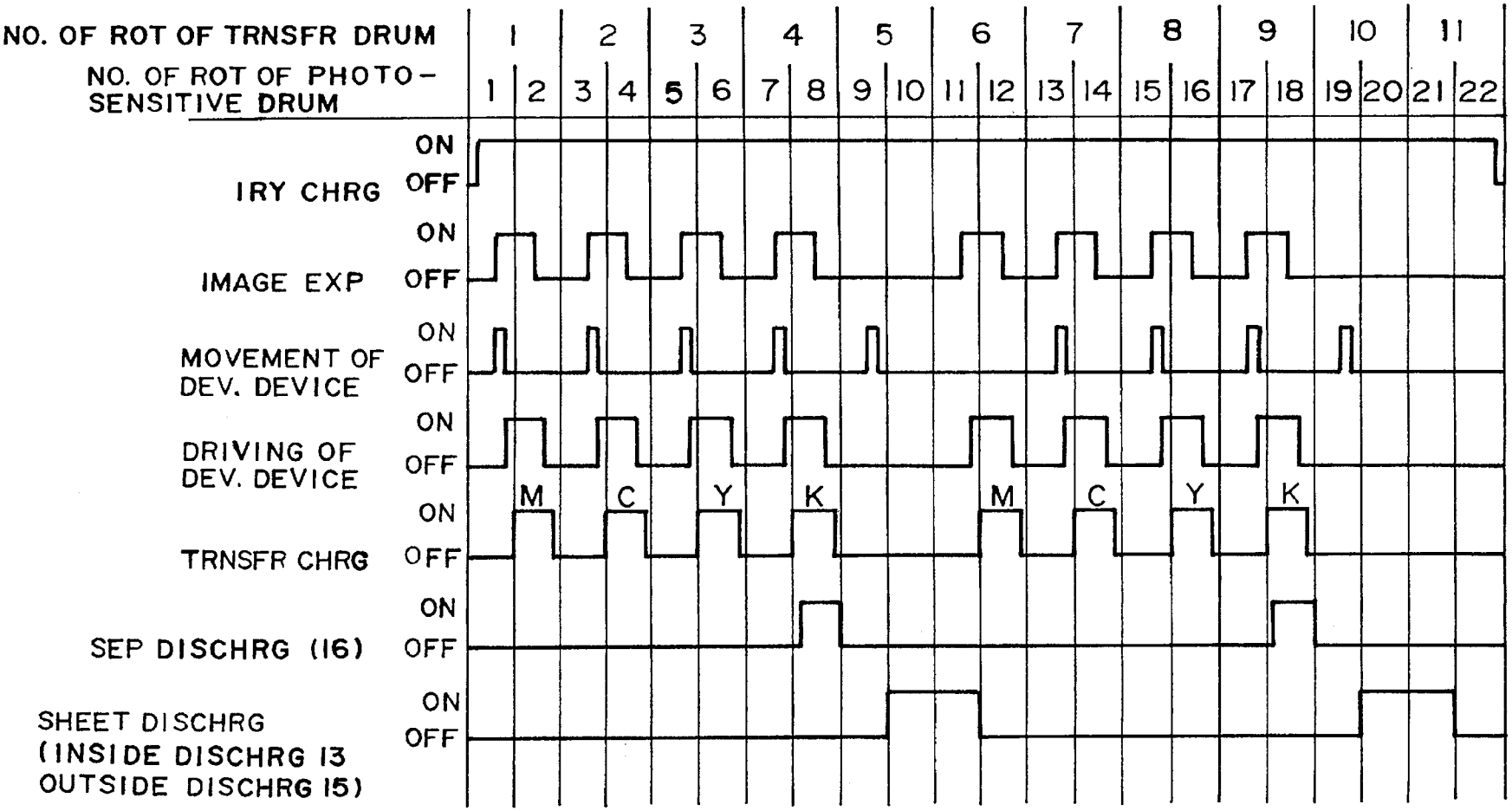
FIG. 3 is an image formation sequence diagram for the image forming apparatus illustrated in FIG. 1, with reference to thick paper.
Figure 4:
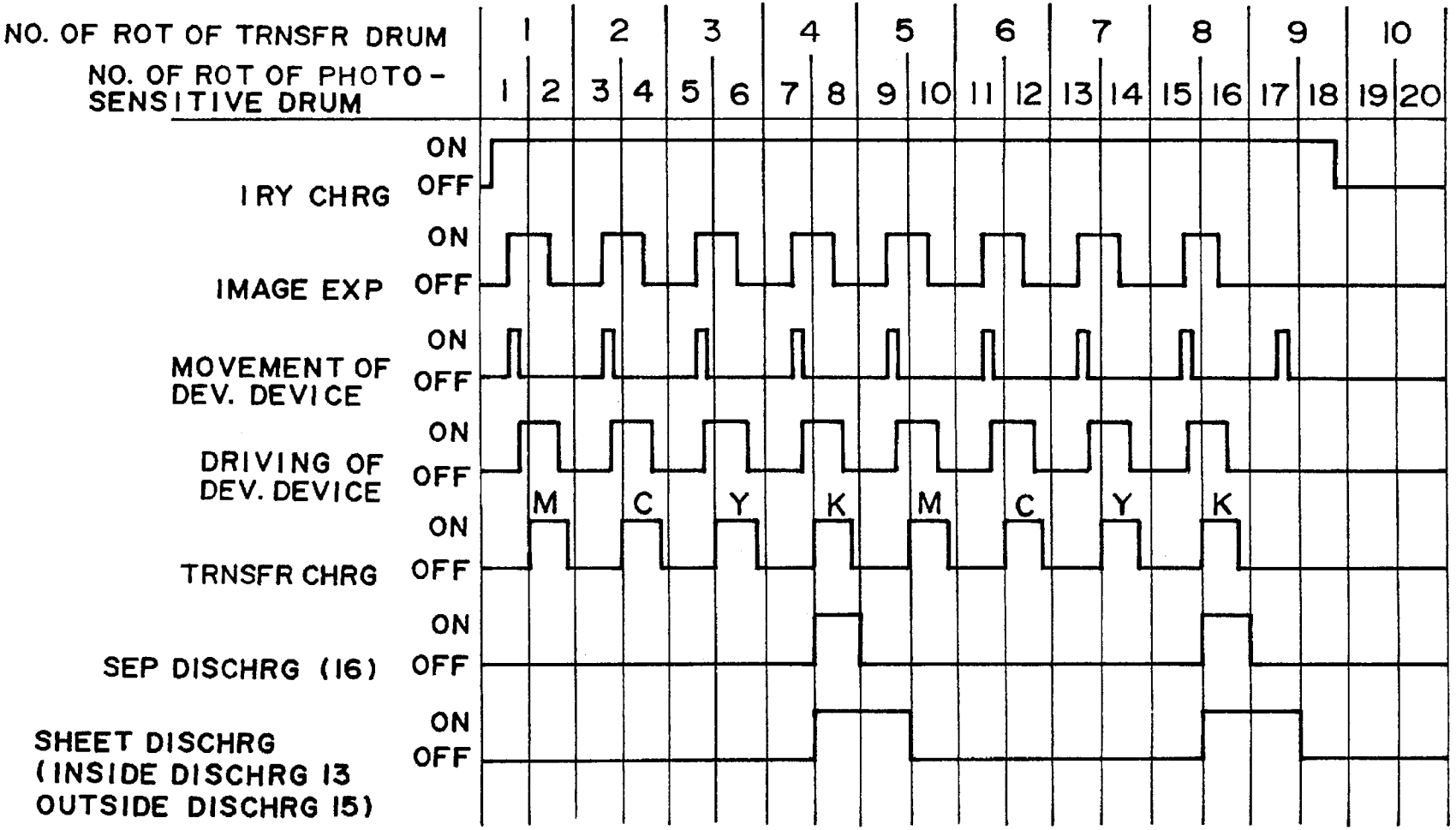
FIG. 4 is an image formation sequence diagram for the image forming apparatus illustrated in FIG. 1, with reference to paper with a normal thickness.

Referring to FIGS. 3 and 4, differences in the operation of the essential portion of the image forming apparatus structured as described before will be described with respect to when the Clark degree of the recording medium P exceeds 156 ($cm^3$/100) and when not, and also, with respect to the rotation of the photosensitive drum 3 and transfer drum 9, following the image formation sequence.

FIG. 3 represents a case in which the recording medium P is thick paper with a Clark degree larger than 156 ($cm^3$/100), and FIG. 4 represents a case in which the recording medium P is thin paper with a Clark degree less than 156 ($cm^3$/100). The size of the recording medium P is A4, and the number of copies to be made consecutively is two. In the case of FIG. 3, "A4" and "2" are chosen for the size and consecutive copy number by a user of the image forming apparatus 1, using the copy count selection key 51 and the thick paper key 55, while watching the large liquid crystal display of the control panel 48. In the case of FIG. 4, "A4" and "2" are chosen, but the thick paper selection by the thick paper key 55 is not made, and therefore, the image forming operation for the normal thickness paper is carried out. Below, the latter case, that is, the case of FIG. 4, will be described first.

As the copy key 50 illustrated in FIG. 2 is depressed, the image forming apparatus 1 begins an image forming operation in a normal thickness paper mode, and the photosensitive drum 3 and transfer drum 9 begin rotating as shown in FIG. 4. The primary charger 5 begins discharging the corona to charge uniformly the surface of the photosensitive drum 3. Then, a laser beam modulated in response to the image forming information correspondent to an original image is irradiated onto the this uniformly charged surface of the photosensitive drum 3, whereby a latent image correspondent to the magenta color component of the original image is formed on the photosensitive drum 3. Next, the magenta color developing device 7M moves into the developing station in synchronism with the magenta component latent image on the photosensitive drum 3, and develops the magenta component image into a visual magenta toner image. Meanwhile, the recording medium P is delivered onto the transfer drum 9 through the registering roller 23 or the like, being borne thereon. As the recording medium P and the connecting member 10*c* of the transfer drum 9 synchronously move into the transfer station, the transfer charger is activated to transfer the magenta toner image onto the recording medium P. Thus, the magenta toner image is formed on the recording medium P.

A similar operation is carried out for the cyan, yellow, and black color components, to form a full-color image composed of superimposed four primary color images, that is, the magenta (M), cyan (C), yellow (Y), and black (K) toner images, on the recording medium P. The recording medium P is separated from the transfer drum 9 substantially at the same period as the transfer of the fourth image, that is, the black toner image, and at this time, the separation discharger 16 is activated to suppress the electrical discharge during the separation. Also substantially at the same time as the beginning of the transfer of the black toner image, the inside and outside dischargers 13 and 15 are activated to discharge the recording medium bearing sheet 11 and the recording medium P. Immediately, the second recording medium P is delivered onto the transfer drum 9, being borne thereon, without allowing the transfer drum 9 to idle, to start the image forming operation for a second copy. In the case of the normal thickness paper mode, the recording medium P is separated in a manner illustrated in FIG. 9.

On the other hand, when the thick paper key 55 is depressed in the thick paper mode, the image forming sequence presented in FIG. 3 is followed. Up to the third color, the sequence is exactly the same as that for the normal thickness paper mode. Next, after the transfer of the fourth toner image, that is, the black toner image, begins, the separation charger 16 is activated to discharge the recording medium bearing sheet 11, which is the same as the normal thickness paper mode. However, in this mode, the separation charger 16 is activated with a different timing. More specifically, the dischargers 13 and 15 are not activated while the recording medium P is separated from the recording medium bearing sheet 11. Instead, they are activated an approximately one full rotation immediately after the separation claw 25 begins to separate the thick recording medium P, that is, after the separation of the recording medium P, and the recording medium bearing sheet 11 is discharged during the following one rotation of the transfer drum 9. Then, as soon as the transfer drum 9 is discharged, the magenta image transfer to the next recording medium P begins. Needless to say, the image forming steps, such as giving the primary charge to the photosensitive drum 3, exposing, developing, and the like, are delayed by one rotation of the transfer drum 9 compared to the sequence according to the prior art.

Figure 9:
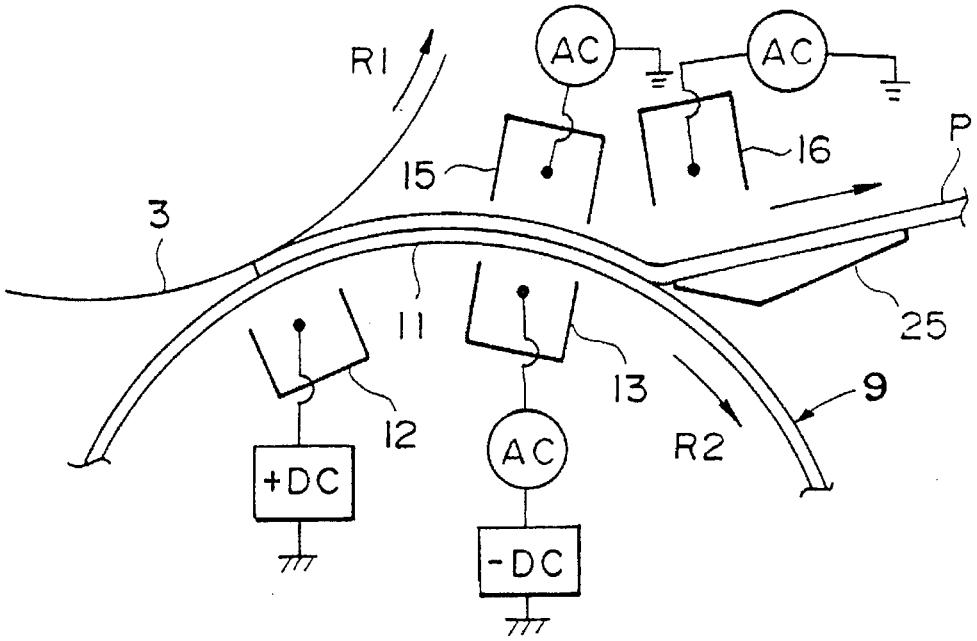
FIG. 9 is a schematic sectional view of the recording medium separating station of the image forming apparatus according to the present invention.

In essence, when the image is formed on the thick paper, the transfer drum 9 is rotated one rotation more than otherwise, to wait till the recording medium P is completely separated from the recording medium bearing sheet 11, and then, the recording medium bearing sheet 11 is discharged. According to this method, the transfer charge having been applied to the recording medium bearing sheet 11 and recording medium P is retained during the separation of the recording medium P, so that the attraction induced between the recording medium bearing sheet 11 and recording medium P by this transfer charge remains strong. Therefore, even when the recording medium P is the very resilient paper having a Clark degree of more than 156 ($cm^3$/100), it can be separated in such a manner as to slide on the upper surface of the separator claw 25 while remaining in contact with the transfer drum 9 as illustrated in FIG. 9.

Thus, in this embodiment, the timing with which the inside discharger 13 or outside discharger 15 is activated during the separation of the recording medium P is changed in response to the thickness of the recording medium P. As a result, the recording medium P can be separated in a preferable manner regardless of the recording medium P thickness.

In other words, the problem that occurs when the image forming sequence according to the prior art is used to form an image on the highly resilient recording medium P such as thick paper having a Clark degree of more than 156 ($cm^3$/100), that is, the problem of the image disturbance that occurs when the recording medium P comes in contact with the outside discharger 15 and/or the separation charger 16, can be eliminated.

In the preceding embodiment example, the value of the current applied to the wire of the separation charger 16 is kept the same for the thick paper having a Clark degree higher than 156 ($cm^3$/100) and the normal thickness paper having a Clark degree not more than 156 ($cm^3$/100). However, in the case of the thick paper, there are times when the separation discharge becomes stronger; therefore, it is preferable to increase the value of the current applied to the wire of the separation discharger 16, so that better results can be obtained.

EMBODIMENT 2

Figure 5:
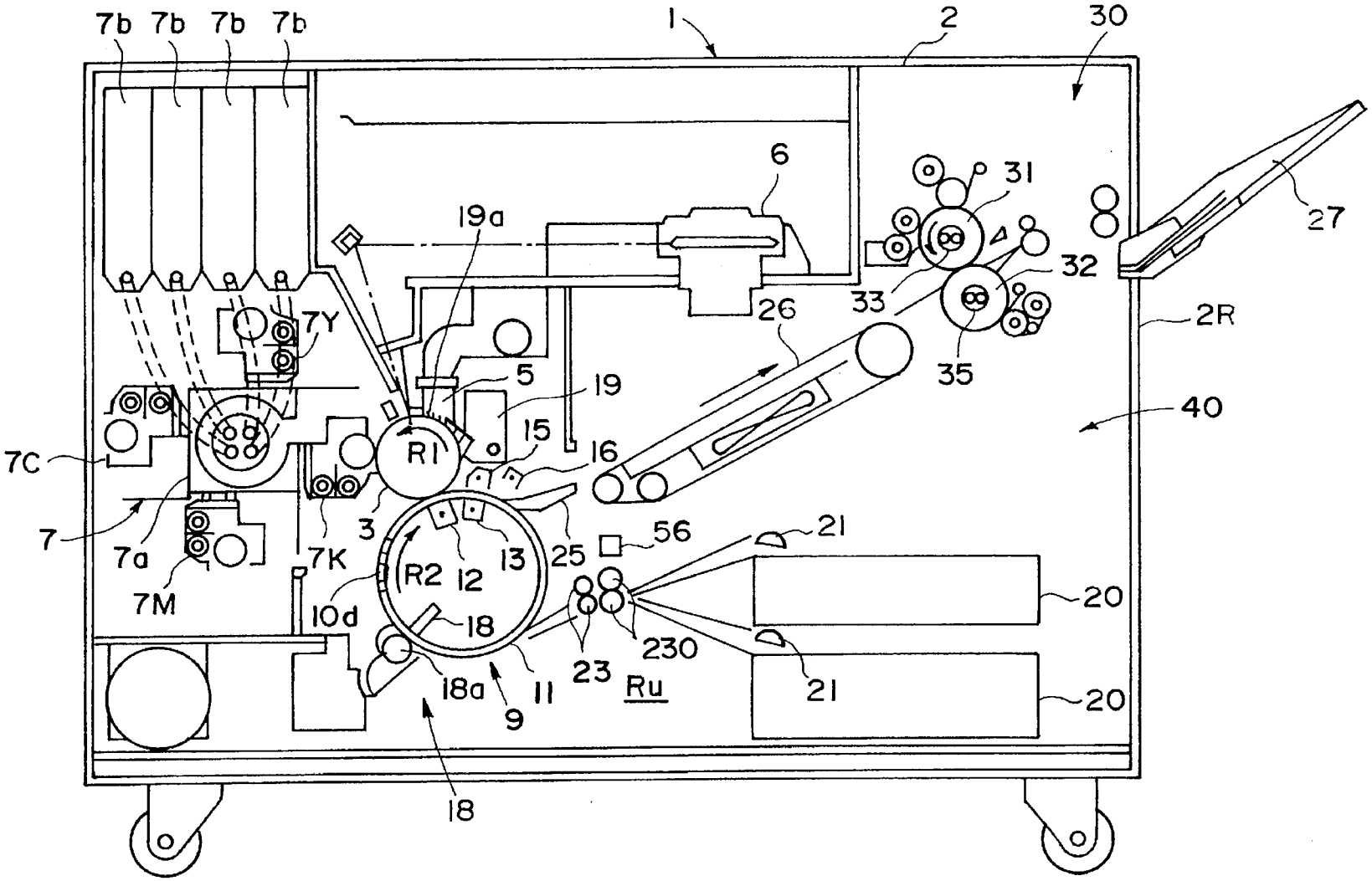
FIG. 5 is a schematic sectional view of another embodiment example of the image forming apparatus according to the present invention.
Figure 6:
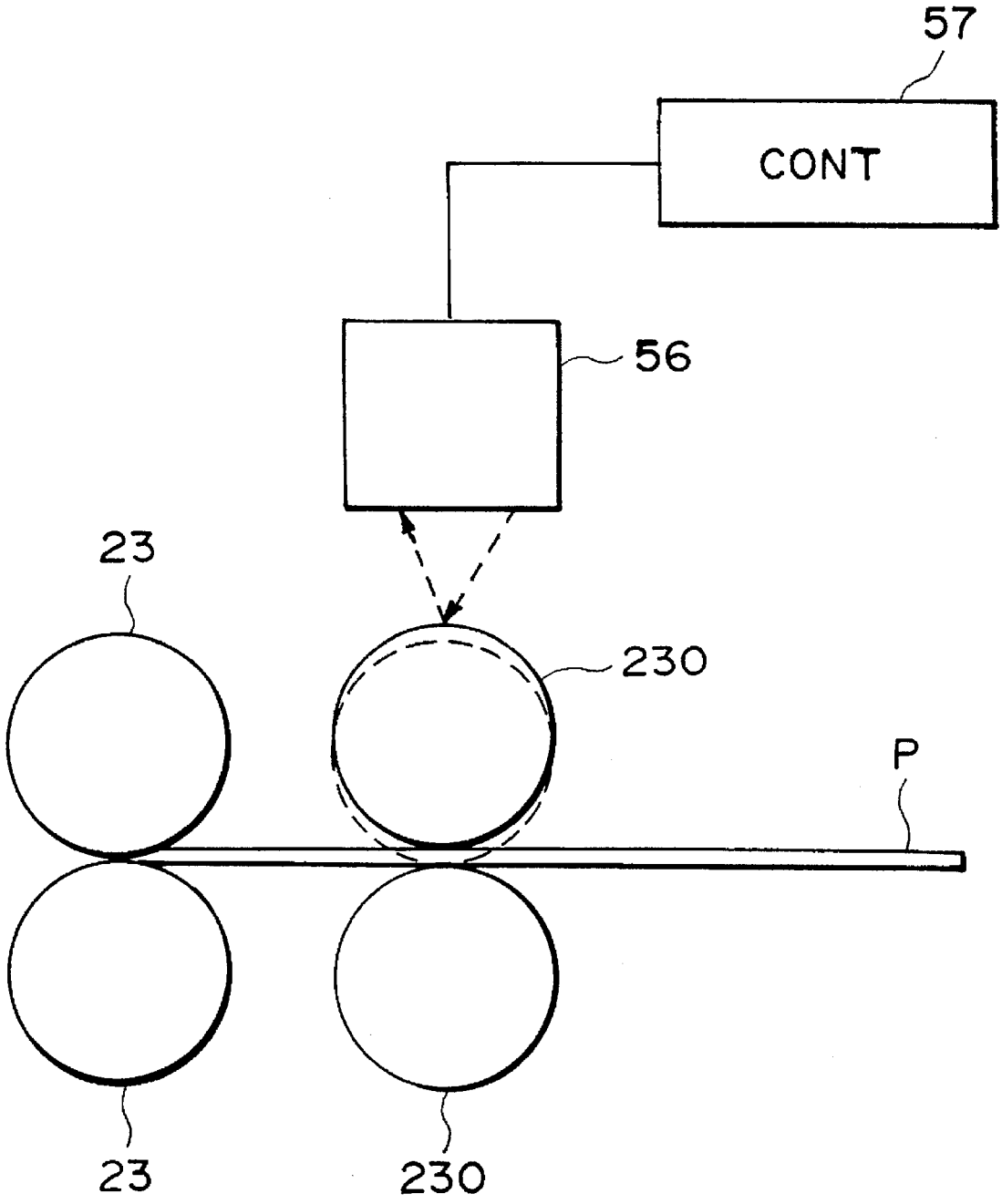
FIG. 6 is a schematic sectional view of the recording medium feeding portion and its adjacencies in the image forming apparatus illustrated in FIG. 5.

FIG. 5 is a schematic sectional view of another example of the embodiment of the image forming apparatus according to the present invention. In the first embodiment, the information regarding whether the recording medium P is thick paper or normal thickness paper is put into the apparatus by the operator, but in this embodiment, the apparatus is enabled to recognize automatically whether the recording medium P is the thick paper or normal thickness paper. More specifically, the apparatus of this embodiment comprises a pair of rollers 230 and a laser based displacement gauge 56. The pair of rollers 230 are disposed in the same section of the recording medium delivery path as the registering roller 23 pair, on the upstream side thereof relative to the delivery direction of the recording medium P, and the laser displacement gauge 56 is disposed close to one of the rollers 230, being aimed thereon. As for the choice of the laser displacement gauge 56, a laser displacement gauge LC-2220 (product of Kabushiki Kaisha KEYENCE), for example, can be employed. This laser displacement gauge 56 is connected to a control apparatus 57 as illustrated in FIG. 6 to process measurement signals.

The recording medium thickness is determined in the following manner. First, a displacement amount T1 of one of the roller 230 is measured when the recording medium P is between the pair of rollers 230, and this displacement amount T1 as the thickness of the recording medium P is sent to the control apparatus 57 in the form of an electrical signal. The control apparatus 57 compares the measured thickness T1 of the recording medium P with a recording medium thickness T0 having been stored in advance. When T1 is larger than T0, it determines that the Clark degree of the recording medium P is larger than 156 ($cm^3$/100), and as a result, the recording medium P is separated in the same manner as when the thick paper key is depressed in the first embodiment, following the same sequence as the one given in FIG. 3. In other words, the transfer drum 9 is rotated substantially one whole turn after the separation of the recording medium P begins, and then, after the recording medium P is separated from the transfer drum 9, the transfer drum 9 is rotated another turn to discharge the recording medium bearing sheet 11. On the other hand, when T1 is less than T0, it is determined that the recording medium P is the normal thickness paper, and the timing chart given in FIG. 4 is followed.

As for the thickness value T0 to be stored in the memory of the control apparatus 57, it may be a value obtained by measuring an actual sheet of recording medium having an approximate Clark degree of 156 ($cm^3$/100). There is a significant correlation between the recording medium thickness and its resiliency; as the recording medium thickness increases, the resiliency also increases. Therefore, the Clark degree of the recording medium can be estimated by measuring its thickness.

According to this embodiment, the thickness of the recording medium P is measured by the displacement gauge 56 when the recording medium P fed out of the sheet feeder cassette 21 is stopped at the registering roller 23 before it is borne on the transfer drum 9, whereby it is determined whether or not the Clark degree of the recording medium P is in excess of 156 ($cm^3$/100). When it is determined that the Clark degree of the recording medium P is in excess of 156 ($cm^3$/100), the image formation is carried out following the sequence given in FIG. 3.

Thus, even when the recording medium P is highly resilient recording medium such as thick paper having a Clark degree of more than 156 ($cm^3$/100), this embodiment example is as successful as the first embodiment, to prevent the image disturbance that occurs when the recording medium P comes in contact with the outside discharger 15 and/or separation discharger 16.

EMBODIMENT 3

Figure 7:
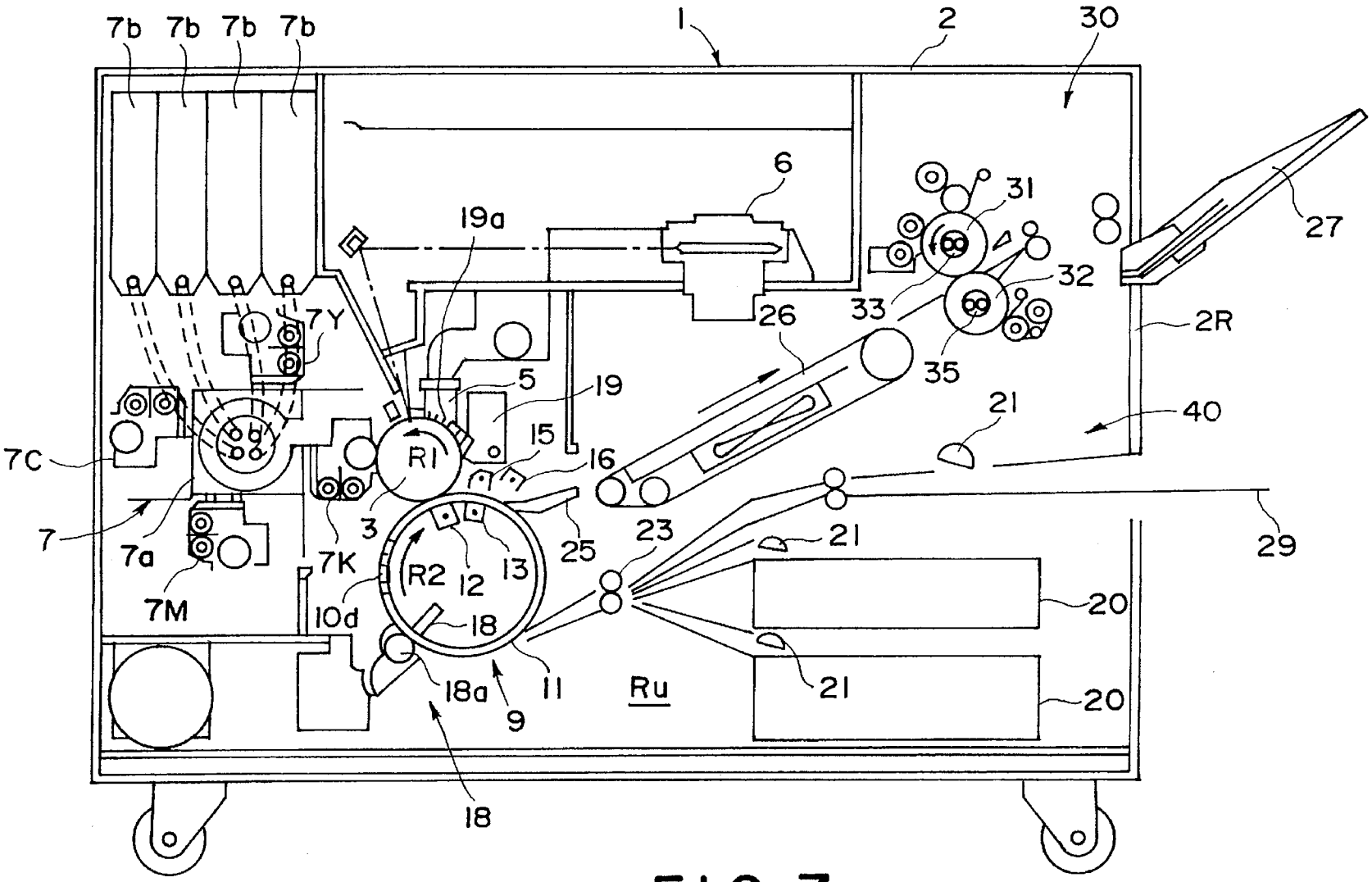
FIG. 7 is a schematic sectional view of another embodiment example of the image forming apparatus according to the present invention.
Figure 8:
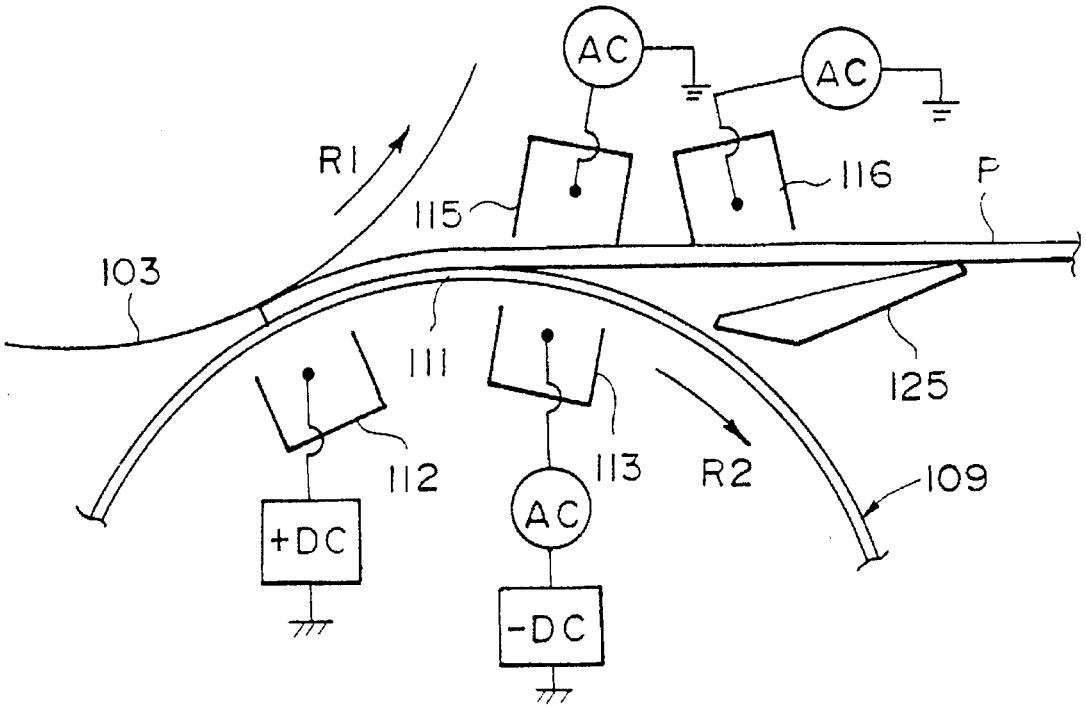
FIG. 8 PRIOR ART
FIG. 8 is a schematic sectional view of the recording medium separating station of the image forming apparatus according to the prior art, and depicts a case in which a sheet of highly resilient recording medium is used.

FIG. 7 is a schematic sectional view of another example of the embodiment of image forming apparatus according to the present invention. This embodiment example is different from the first and second embodiments, in that a manual sheet feeder tray 29 is provided in the sheet feeding station.

Generally speaking, it is difficult to feed the thick paper from the cassette. Therefore, it is preferred for the thick paper to be fed through a manual sheet feeder tray such as the manual sheet feeder tray 29 of this embodiment. This embodiment example is designed so that when the recording medium P is placed in the manual sheet feeder tray 29, a thick paper mode such as those of the first and second embodiments illustrated in FIG. 3 is automatically set. On the other hand, when the recording medium P is not placed in the manual sheet feeder tray 29, it is automatically determined that the recording medium P is the normal thickness paper and the recording medium P is fed out of the cassette 20, and as the recording medium P begins to be fed, the timing chart given in FIG. 4 is followed.

Thus, this embodiment also makes it possible to always form images without the image disturbance, just like the first and second embodiments.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

a recording material carrying member that carries recording material;

image forming means for forming an image on the recording material carried on the recording material carrying member, in an image forming station; and discharging means for discharging the recording material after the image is formed on the recording material, said discharging means comprising an outside discharger disposed adjacent an image bearing surface side of the recording material;

wherein a discharging operation of the discharging means is changed in response to a rigidity value of the recording material, wherein when the recording material having a rigidity value larger than a predetermined value of a Clark rigidity of 156 ($cm^3$/100) is separated from the recording material carrying member, the discharging power of the discharging means is rendered weaker than when the recording material having a rigidity value no more than the predetermined value is separated from the recording material carrying member.

2. An image forming apparatus according to claim 1, wherein when the recording material is separated from the recording material carrying member, the discharging operation of the discharging means is changed in response to the rigidity of the recording material.

3. An image forming apparatus according to claim 1, wherein when the recording material having a rigidity value larger than the predetermined value is separated from the recording material carrying member, the discharging means is turned off, and when the recording material having a rigidity value no more than the predetermined value is separated from the recording material carrying member, the discharging means is turned on.

4. An image forming apparatus according to claim 3, wherein when the rigidity value of the recording material is larger than the predetermined value, the discharging means discharges the recording material carrying member after the recording material is separated from the recording material carrying member.

5. An image forming apparatus according to claim 1, further comprising a separating member to be interposed between the recording material carrying member and recording material when the recording material is separated from the recording material carrying member.

6. An image forming apparatus according to claim 1, wherein the discharging means further comprises an inside discharger, disposed adjacent the side opposite from the outside discharger with respect to the recording material carrying member, in such a manner as to oppose the outside discharger.

7. An image forming apparatus according to claim 1, wherein the image forming means includes an image bearing member, and transfer-charging means for transferring the image from the image bearing member onto the recording material carried on the recording material carrying member.

8. An image forming apparatus according to one of claims 1, 2, 3, 4, 6 or 7, further comprising a separating member to be interposed between the recording material carrying member and recording material when the recording material is separated from the recording material carrying member, and the discharging means is disposed downstream of the image forming station and upstream of the separating member, with respect to the moving direction of the recording material carrying member.

9. An image forming apparatus according to claim 1, wherein when the recording material is separated from the recording material carrying member, the discharging operation of the discharging means is changed depending on whether the recording material is manually fed or automatically fed from the cassette.

10. An image forming apparatus according to claim 7, wherein a plurality of images of different color are transferred onto the recording material carried on the recording material carrying member, in a superimposing manner.

11. An image forming apparatus comprising:

a recording material carrying member for carrying a recording material;

image forming means for forming an image on the recording material carried on a recording material carrying member at an image forming station;

a separation member to be interposed between the recording material and the recording material carrying member when the recording material is separated from the recording material carrying member;

discharging means disposed downstream of the image forming station and upstream of said separation member, said discharging means comprises an outside charger adjacent to an image bearing surface side of the recording material;

wherein when the recording material has a rigidity larger than a predetermined rigidity, the discharging means stops its discharging operation when the recording material is separated, and resumes its operation after the recording material is separated from the recording material carrying member, and wherein the predetermined rigidity is a Clark rigidity of 156 ($cm^3$/100).

12. An image forming apparatus according to claim 11, wherein the discharging means further comprises an inside discharger, disposed on the side opposite from the outside discharger with respect to the recording material carrying member, in such a manner as to oppose the outside discharger.

13. An image forming apparatus according to claim 11, wherein said image forming means includes an image bearing member, and transfer-charging means for transferring the image from the image bearing member onto the recording material carried on the recording material carrying member.

14. An image forming apparatus according to claim 11, wherein when the recording material is separated from the recording material carrying member, the discharging operation of the discharging means is changed depending on whether the recording material is manually fed or automatically fed from the cassette.

15. An image forming apparatus according to claim 13, wherein a plurality of images of different color are transferred onto the recording material carried on the recording material carrying member, in a superimposing manner.

16. An image forming apparatus comprising:

a recording material carrying member that carries recording material;

image forming means for forming an image on the recording material carried on the recording material carrying member, in an image forming station;

a separating member to be inserted between said recording material carrying member and a side of said recording material opposite from an unfixed image bearing side thereof;

discharging means for electrically discharging the recording material when the recording material is separated from said recording material carrying member;

wherein said discharging means being capable of being supplied with a DC component, and wherein when a rigidity of said recording material is larger than a predetermined rigidity, an absolute value of the DC component is smaller than when the rigidity of said recording material is not larger than the predetermined rigidity.

17. An apparatus according to claim 16, wherein the DC component is zero, when the rigidity of the paper is larger than the predetermined rigidity.

18. An apparatus according to claim 16 or 17, wherein the predetermined rigidity is 156 $cm^3$/100 in Clark rigidity.

19. An apparatus according to claim 16, wherein said discharging means comprises an outside discharger disposed adjacent an image bearing surface side of the recording material, and wherein said outside discharger being capable of being supplied with a DC component, and wherein when a rigidity of said recording material is larger than a predetermined rigidity, the DC component is smaller than when the rigidity of the paper is not larger than the predetermined rigidity.

20. An apparatus according to claim 16, wherein said discharging means comprises an inside discharger disposed adjacent an image bearing surface side of the recording material, and wherein said inside discharger being capable of being supplied with a DC component, and wherein when a rigidity of paper as said recording material is larger than a predetermined rigidity, the DC component is smaller than when the rigidity of the paper is not larger than the predetermined rigidity.

21. An apparatus according to claim 19, wherein the discharging means further comprises an inside discharger, disposed adjacent the side opposite from the outside discharger with respect to the recording material carrying member, in such a manner as to oppose the outside discharger; and wherein said inside discharger being capable of being supplied with a DC component, and wherein when a rigidity of paper as said recording material is larger than a predetermined rigidity, the DC component is smaller than when the rigidity of the paper is not larger than the predetermined rigidity.

22. An apparatus according to claim 17, wherein when the rigidity of the paper is larger than the predetermined rigidity, said discharging means discharges said recording material carrying member after said paper is separated from said recording material carrying member, and when the rigidity of the paper is not larger than the predetermined rigidity, said discharging means discharges the recording material and said recording material carrying member when the recording material is separated from said recording material carrying member.

23. An apparatus according to claim 16, wherein the image forming means includes an image bearing member, and transfer-charging means for transferring the image from the image bearing member onto the recording material carried on the recording material carrying member.

24. An apparatus according to claim 16, wherein when the recording material is separated from the recording material carrying member, the discharging operation of the discharging means is changed depending on whether the recording material is manually fed or automatically fed from the cassette.

25. An apparatus according to claim 23, wherein a plurality of images of different colors are transferred onto the recording material carried on the recording material carrying member, in a superimposing manner.

* * * * *

UNITED STATES PATENT AND TRADEMARK OFFICE

CERTIFICATE OF CORRECTION

PATENT NO. : 5,655,176

DATED : August 5, 1997

INVENTORS : Masahiro Inoue, et al.

It is certified that error appears in the above-identified patent and that said Letters Patent is hereby corrected as shown below:

ON THE COVER:

Under [56] References Cited, Foreign Patent Documents,
"0004062 1/1982 Japan" should be deleted;
"0064270 4/1982 Japan" should be deleted;
"0005756 1/1983 Japan" should be deleted;
"0190885 7/1990 Japan" should be deleted; and
"2190885" should read -- 2-190885--.

COLUMN 1

Line 34, "when" should read --When--.

Signed and Sealed this

Twenty-fourth Day of February, 1998

*Attest:*

*Attesting Officer*

BRUCE LEHMAN

*Commissioner of Patents and Trademarks*